US008026894B2

(12) United States Patent
Feng

(10) Patent No.: US 8,026,894 B2
(45) Date of Patent: Sep. 27, 2011

(54) METHODS AND SYSTEMS FOR MOTION ADAPTIVE BACKLIGHT DRIVING FOR LCD DISPLAYS WITH AREA ADAPTIVE BACKLIGHT

(75) Inventor: Xiao-Fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 1040 days.

(21) Appl. No.: 11/843,529

(22) Filed: Aug. 22, 2007

(65) Prior Publication Data

US 2007/0285382 A1 Dec. 13, 2007

Related U.S. Application Data

(63) Continuation-in-part of application No. 11/219,888, filed on Sep. 6, 2005, and a continuation-in-part of application No. 11/157,231, filed on Jun. 20, 2005, and a continuation-in-part of application No. 10/966,258, filed on Oct. 15, 2004.

(60) Provisional application No. 60/940,378, filed on May 25, 2007.

(51) Int. Cl.
*G09G 3/36* (2006.01)
*G09G 3/34* (2006.01)

(52) U.S. Cl. ..... 345/102; 345/84; 345/87

(58) Field of Classification Search ..... 345/102
See application file for complete search history.

(56) References Cited

U.S. PATENT DOCUMENTS

| | | | | |
|---|---|---|---|---|
| 5,978,142 | A | 11/1999 | Blackham | |
| 6,268,843 | B1 | 7/2001 | Arakawa | |
| 7,317,445 | B2 * | 1/2008 | Hekstra et al. | 345/102 |
| 2002/0021292 | A1 | 2/2002 | Sakashita | |
| 2002/0050987 | A1 | 5/2002 | Sakashita | |
| 2004/0095558 | A1 | 5/2004 | Whitehead | |
| 2005/0073495 | A1 | 4/2005 | Harbers | |
| 2005/0162737 | A1 | 7/2005 | Whitehead | |
| 2005/0184952 | A1 * | 8/2005 | Konno et al. | 345/102 |

FOREIGN PATENT DOCUMENTS

WO WO03077013 9/2003

OTHER PUBLICATIONS

H. Seetzen, W. Heidrich, W. Stuerzlinger, G. Ward, L. Whitehead, M. Trentacoste, A. Ghosh, and A. Vorozcovs, High Dynamic Range Display Systems, ACM SIGGRAPH 2004.

* cited by examiner

*Primary Examiner* — Alexander S Beck
*Assistant Examiner* — Charles Hicks
(74) *Attorney, Agent, or Firm* — Krieger Intellectual Property, Inc.; Scott C. Krieger

(57) ABSTRACT

Elements of the present invention relate to systems and methods for generating, modifying and applying backlight array driving values.

21 Claims, 7 Drawing Sheets

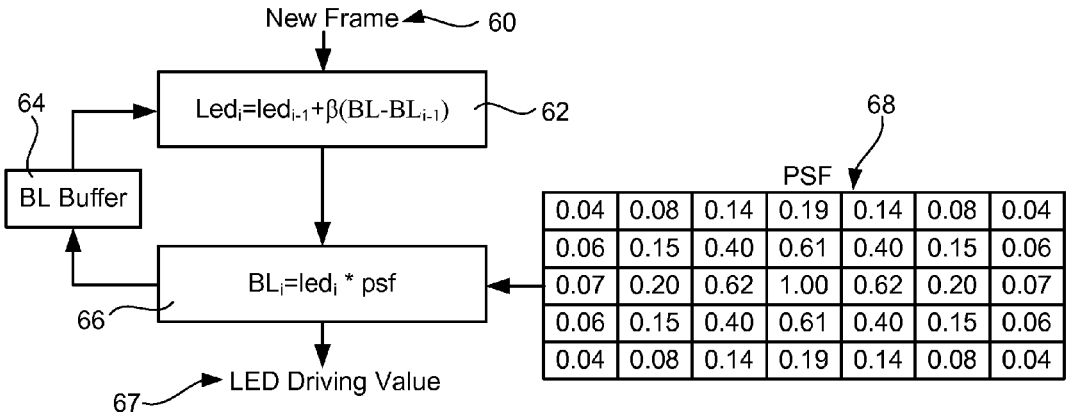
| | | | | | | |
|---|---|---|---|---|---|---|
| 0.04 | 0.08 | 0.14 | 0.19 | 0.14 | 0.08 | 0.04 |
| 0.06 | 0.15 | 0.40 | 0.61 | 0.40 | 0.15 | 0.06 |
| 0.07 | 0.20 | 0.62 | 1.00 | 0.62 | 0.20 | 0.07 |
| 0.06 | 0.15 | 0.40 | 0.61 | 0.40 | 0.15 | 0.06 |
| 0.04 | 0.08 | 0.14 | 0.19 | 0.14 | 0.08 | 0.04 |
FIG. 5
| | | |
|---|---|---|
| | i-1,j | |
| I,j-1 | i,j | I,j+1 |
| | i+1,j | |
FIG. 6
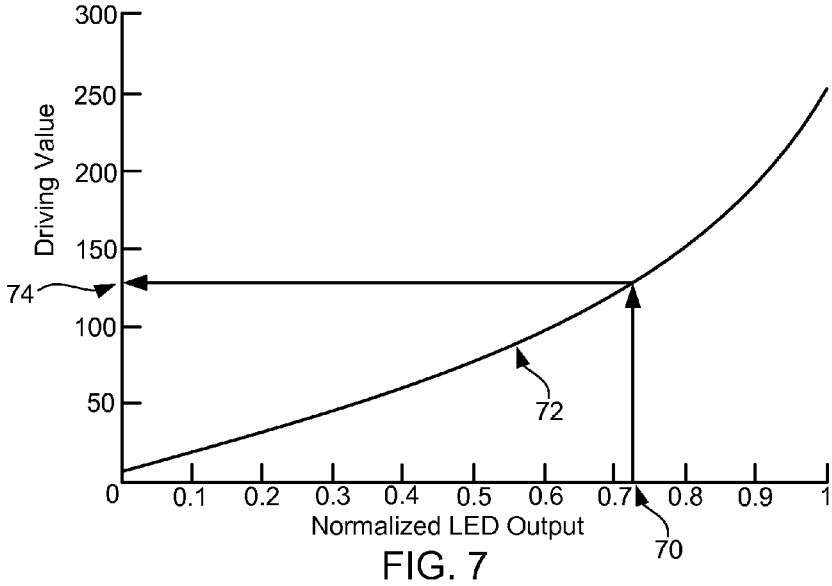
FIG. 7

METHODS AND SYSTEMS FOR MOTION ADAPTIVE BACKLIGHT DRIVING FOR LCD DISPLAYS WITH AREA ADAPTIVE BACKLIGHT

RELATED REFERENCES

This application claims the benefit of U.S. Provisional Patent Application No. 60/940,378, entitled "Methods and Systems for Motion Adaptive Backlight Driving for LCD Displays with Area Adaptive Backlight," filed on May 25, 2007; this application is also a continuation-in-part of U.S. patent application Ser. No. 10/966,258, entitled "Adaptive Flicker and Motion Blur Control," filed on Oct. 15, 2004; this application is also a continuation-in-part of U.S. patent application Ser. No. 11/219,888, entitled "Black Point Insertion," filed on Sep. 6, 2005; and this application is also a continuation-in-part of U.S. patent application Ser. No. 11/157,231, entitled "Image Display Device with Reduced Flickering and Blur," filed on Jun. 20, 2005. All applications listed in this section are hereby incorporated herein by reference.

FIELD OF THE INVENTION

Embodiments of the present invention comprise methods and systems for generating, modifying and applying backlight driving values for an LED backlight array.

BACKGROUND

Some displays, such as LCD displays, have backlight arrays with individual elements that can be individually addressed and modulated. The displayed image characteristics can be improved by systematically addressing backlight array elements.

SUMMARY

Some embodiments of the present invention comprise methods and systems for generating, modifying and applying backlight driving values for an LED backlight array.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

FIG. 5 is a chart showing an exemplary method for deriving LED driving values;

FIG. 6 is a diagram showing an exemplary error diffusion method;

FIG. 7 is a graph showing an exemplary inverse gamma correction;

DETAILED DESCRIPTION OF EXEMPLARY EMBODIMENTS

Figure 1:
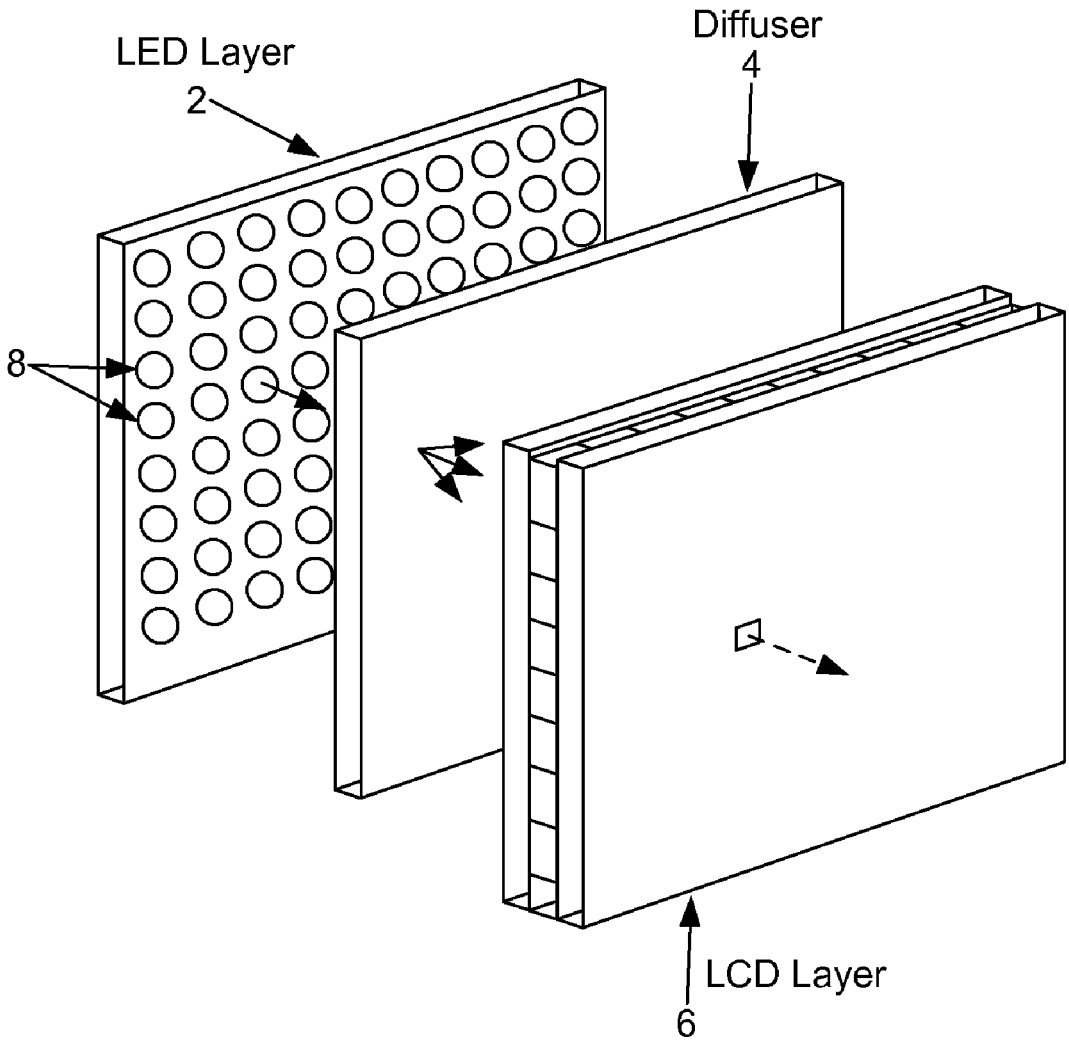
FIG. 1 is a diagram showing a typical LCD display with an LED backlight array.

Embodiments of the present invention will be best understood by reference to the drawings, wherein like parts are designated by like numerals throughout. The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the methods and systems of the present invention is not intended to limit the scope of the invention but it is merely representative of the presently preferred embodiments of the invention.

Elements of embodiments of the present invention may be embodied in hardware, firmware and/or software. While exemplary embodiments revealed herein may only describe one of these forms, it is to be understood that one skilled in the art would be able to effectuate these elements in any of these forms while resting within the scope of the present invention.

In a high dynamic range (HDR) display, comprising an LCD using an LED backlight, an algorithm may be used to convert the input image into a low resolution LED image, for modulating the backlight LED, and a high resolution LCD image. To achieve high contrast and save power, the backlight should contain as much contrast as possible. The higher contrast backlight image combined with the high resolution LCD image can produce much higher dynamic range image than a display using prior art methods. However, one issue with a high contrast backlight is motion-induced flickering. As a moving object crosses the LED boundaries, there is an abrupt change in the backlight: In this process, some LEDs reduce their light output and some increase their output; which causes the corresponding LCD to change rapidly to compensate for this abrupt change in the backlight. Due to the timing difference between the LED driving and LCD driving, or an error in compensation, fluctuation in the display output may occur causing noticeable flickering along the moving objects. The current solution is to use infinite impulse response (IIR) filtering to smooth the temporal transition, however, this is not accurate and also may cause highlight clipping.

An LCD has limited dynamic range due the extinction ratio of polarizers and imperfections in the LC material. In order to display high-dynamic-range images, a low resolution LED backlight system may be used to modulate the light that feeds into the LCD. By the combination of modulated LED backlight and LCD, a very high dynamic range (HDR) display can be achieved. For cost reasons, the LED typically has a much lower spatial resolution than the LCD. Due to the lower resolution LED, the HDR display, based on this technology, can not display high dynamic pattern of high spatial resolution. But, it can display an image with both very bright areas (>2000 cd/m$^2$) and very dark areas (<0.5 cd/m$^2$) simultaneously. Because the human eye has limited dynamic range in a local area, this is not a significant problem in normal use. And, with visual masking, the eye can hardly perceive the limited dynamic range of high spatial frequency content.

Another problem with modulated-LED-backlight LCDs is flickering along the motion trajectory, i.e. the fluctuation of display output. This can be due to the mismatch in LCD and LED temporal response as well as errors in the LED point spread function (PSF). Some embodiments may comprise temporal low-pass filtering to reduce the flickering artifact, but this is not accurate and may also cause highlight clipping. In embodiments of the present invention, a motion adaptive LED driving algorithm may be used. A motion map may be derived from motion detection. In some embodiments, the LED driving value may also be dependent on the motion status. In a motion region, an LED driving value may be derived such that the contrast of the resulting backlight is reduced. The reduced contrast also reduces a perceived flickering effect in the motion trajectory.

Some embodiments of the present invention may be described with reference to FIG. 1, which shows a schematic of an HDR display with an LED layer 2, comprising individual LEDs 8 in an array, as a backlight for an LCD layer 6. The light from the array of LEDs 2 passes through a diffusion layer 4 and illuminates the LCD layer 6.

In some embodiments, the backlight image is given by $$\mathrm{bl}(x,y)=\mathrm{LED}(i,j)*\mathrm{psf}(x,y) \tag{1}$$

where LED(i,j) is the LED output level of each individual LED in the backlight array, psf(x,y) is the point spread function of the diffusion layer and * denotes a convolution operation. The backlight image may be further modulated by the LCD.

The displayed image is the product of the LED backlight and the transmittance of the LCD: $T_{LCD}(x,y)$.

$$\mathrm{img}(x,y)=\mathrm{bl}(x,y)T_{LCD}(x,y)=(\mathrm{led}(i,j)*\mathrm{psf}(x,y))T_{LCD}(x,y) \tag{2}$$

By combining the LED and LCD, the dynamic range of the display is the product of the dynamic range of LED and LCD. For simplicity, in some embodiments, we use a normalized LCD and LED output between 0 and 1.

Figure 2:
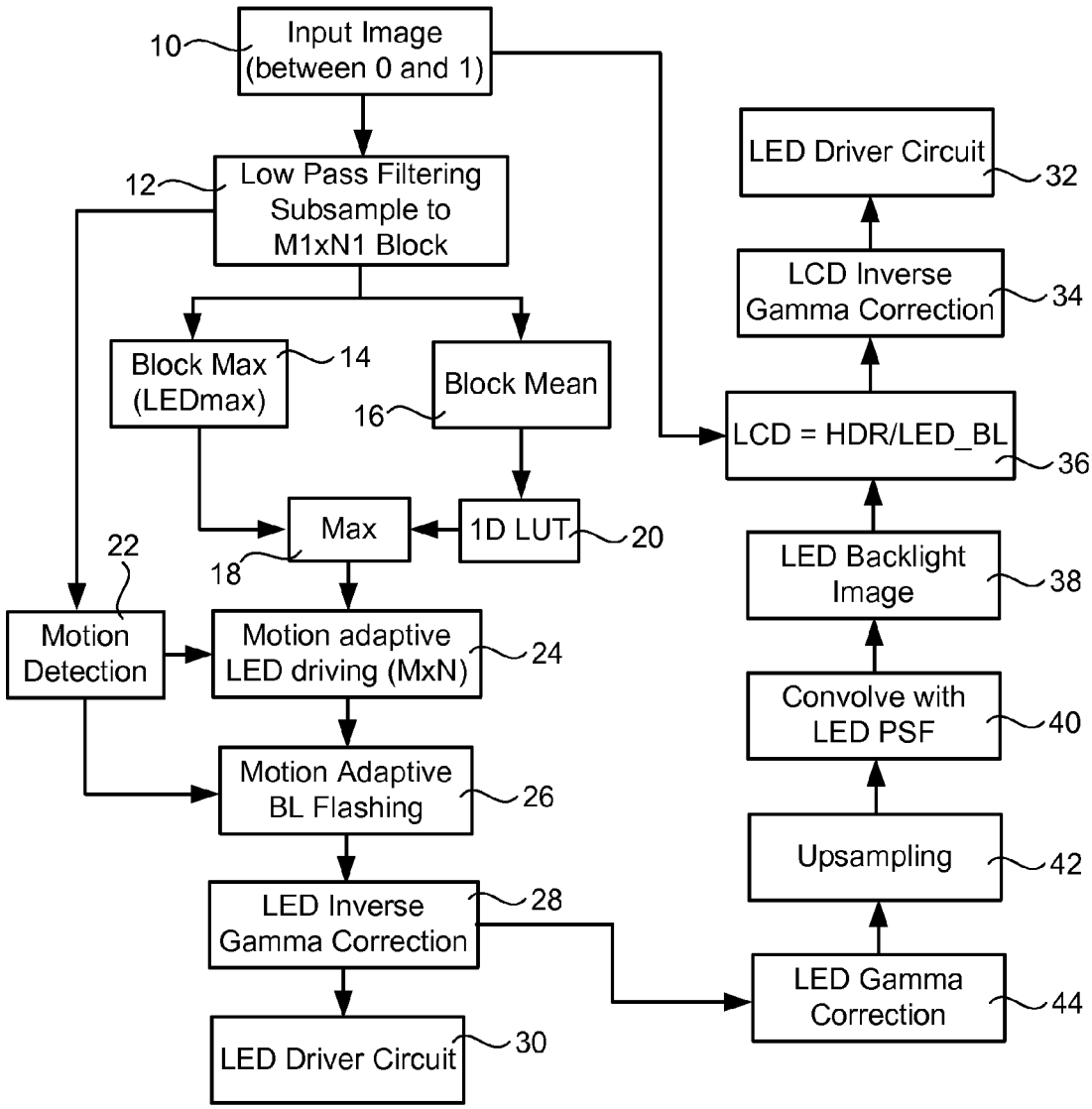
FIG. 2 is a chart showing motion adaptive LED backlight driving.

Some exemplary embodiments of the present invention may be described with reference to FIG. 2, which shows a flowchart for an algorithm to convert an input image into a low-resolution LED backlight image and a high-resolution LCD image. The LCD resolution is m×n pixels with its range from 0 to 1, with 0 representing black and 1 representing the maximum transmittance. The LED resolution is M×N with M<m and N<n. We assume that the input image has the same resolution as the LCD image. If the input image is a different resolution, a scaling or cropping step may be used to convert the input image to the LCD image resolution. In some embodiments, the input image may be normalized 10 to values between 0 and 1.

In these embodiments, the image may be low-pass filtered and sub-sampled 12 to an intermediate resolution. In some embodiments, the intermediate resolution will be a multiple of the LED array size (aM×aN). In an exemplary embodiment, the intermediate resolution may be 8 times the LED resolution (8M×8N). The extra resolution may be used to detect motion and to preserve the specular highlight. The maximum of the intermediate resolution image forms the Blockmax image (M×N) 14. This Blockmax image may be formed by taking the maximum value in the intermediate resolution image (aM×sN) corresponding to each block to form an M×N image. A Blockmean image 16 may also be created by taking the mean of each block used for the Blockmax image.

Figure 3:
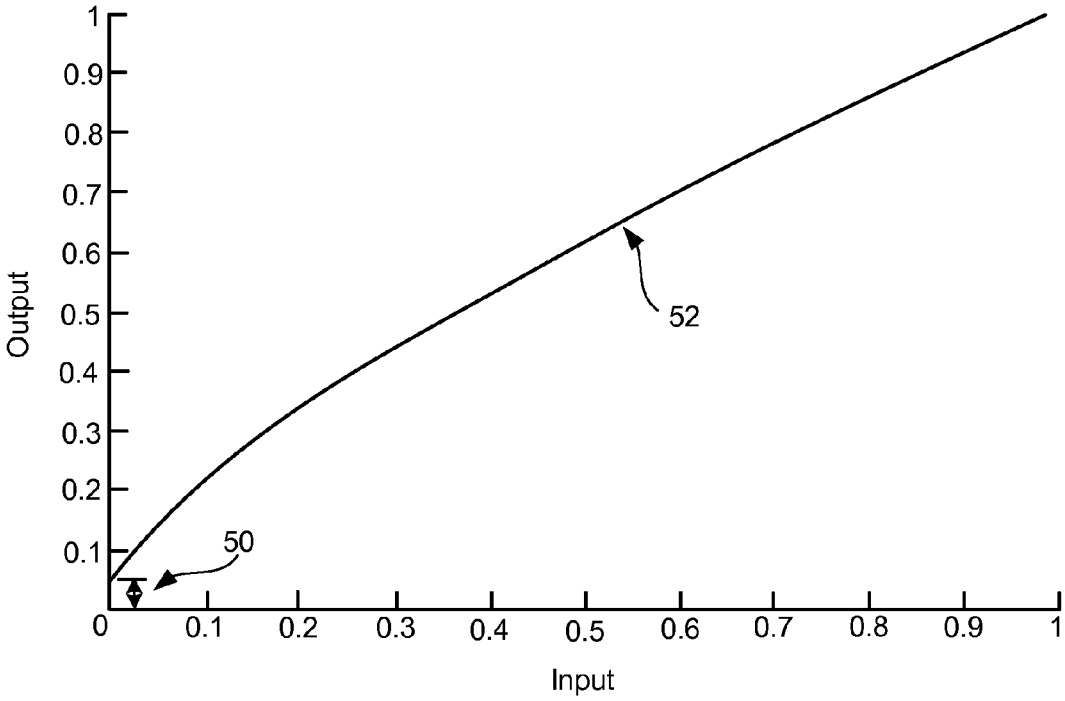
FIG. 3 is a graph showing an exemplary tone mapping.

In some embodiments, the Blockmean image 16 may then be tone mapped 20. In some embodiments, tone mapping may be accomplished with a 1D LUT, such as is shown in FIG. 3. In these embodiments, the tone mapping curve may comprise a dark offset 50 and expansion nonlinearity 52 to make the backlight at dark region slightly higher. This may serve to reduce the visibility of dark noise and compression artifacts. The maximum of the tone-mapped Blockmean image and the Blockmax image is generated 18 used as the target backlight value, LED1. These embodiments take into account the local maximum thereby preserving the specular highlight. LED1 is the target backlight level and its size is the same as the number of active backlight elements (M×N).

Flickering in the form of intensity fluctuation can be observed when an object moves cross LED boundaries. This object movement can cause an abrupt change in LED driving values. Theoretically, the change in backlight can be compensated by the LCD. But due to timing differences between the LED and the LCD, and mismatch in the PSF used in calculating the compensation and the actual PSF of the LED, there is typically some small intensity variation. This intensity variation might not be noticeable when the eye is not tracking the object motion, but when the eye is tracking the object motion, this small intensity change can become a periodic fluctuation. The frequency of the fluctuation is the product of video frame rate and object motion speed in terms of LED blocks per frame. If an object moves across an LED block in 8 video frames and the video frame rate is 60 Hz, the flickering frequency is 60 hz*0.125=7.5 Hz. This is about the peak of human visual sensitivity to flickering and it can result in a very annoying artifact.

To reduce this motion flickering, a motion adaptive algorithm may be used to reduce the sudden LED change when an object moves across the LED grids. Motion detection may be used to divide a video image into two classes: a motion region and a still region. In the motion region, the backlight contrast is reduced so that there is no sudden change in LED driving value. In the still region, the backlight contrast is preserved to improve the contrast ratio and reduce power consumption.

Motion detection may be performed on the subsampled image at aM×aN resolution. The value at a current frame may be compared to the corresponding block in the previous frame. If the difference is greater than a threshold, then the backlight block that contains this block may be classified as a motion block. In an exemplary embodiment, each backlight block contains 8×8 sub-elements. In some exemplary embodiments, the process of motion detection may be performed as follows:

For each frame, 1. calculate the average of each sub-element in the input image for the current frame,
2. if the difference between the average in this frame and the sub-element average of the previous frame is greater than a threshold (e.g., 5% of total range, in an exemplary embodiment), then the backlight block that contains the sub-element is classified as a motion block. In this manner a first motion map may be formed.
3. Perform a morphological dilation operation or other image process technique on the first motion map (change the still blocks neighboring a motion block to motion blocks) to form a second enlarged motion map.
4. For each backlight block, the motion status map is updated based on the motion detection results:

if it is a motion block, $$m\mathrm{Map}_t(i,j)=\min(4,m\mathrm{Map}_{t-1}(i,j)+1);$$

else (still block)

$$m\mathrm{Map}_t(i,j)=\max(0,m\mathrm{Map}_{t-1}(i,j)-1);$$

The LED driving value is given by $$LED_2(i, j) = \left(1 - \frac{mMap}{4}\right)LED_1(i, j) + \frac{mMap}{4}LED_{max}(i, j) \quad (3)$$

where $LED_{max}$ is the local max of LEDs in a window that centers on the current LED. One example is a 3×3 window. Another example is a 5×5 window.

In some embodiments, motion estimation may be used. In these embodiments, the window may be aligned with a motion vector. In some embodiments, the window may be one-dimensional and aligned with the direction of the motion vector. This approach reduces the window size and preserves the contrast in the non-motion direction, but the computation of a motion vector is much more complex than simple motion detection. In some embodiments, the motion vector values may be used to create the enlarged motion map. In some embodiments, the motion vector values may be normalized to a value between 0 and 1. In some embodiments, any motion vector value above 0 may be assigned a value of 1. The motion status map may then be created as described above and the LED driving values may be calculated according to equation 4, however, LEDmax would be determined with a 1D window aligned with the motion vector.

Figure 4:
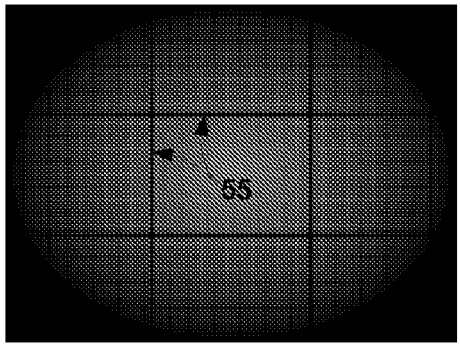
FIG. 4 is an image illustrating an exemplary LED point spread function.

Since the PSF of the LED is larger than the LED spacing to provide a more uniform backlight image, there is considerable crosstalk between the LED elements that are located close together. FIG. 4 shows a typical LED PSF where the black lines 55 within the central circle of illumination indicate the borders between LED array elements. From FIG. 4, it is apparent that the PSF extends beyond the border of the LED element.

Because of the PSF of the LEDs, any LED has contribution from each of its neighboring LEDs. Although Equation 2 can be used to calculate the backlight, given an LED driving signal, deriving the LED driving signal to achieve a target backlight image is an inverse problem. This is an ill-posed de-convolution problem. In one approach, a convolution kernel is used to derive the LED driving signal as shown in Equation 3. The crosstalk correction kernel coefficients ($c_1$ and $c_2$) are negative to compensate for the crosstalk from neighboring LEDs.

$$\text{crosstalk} = \begin{vmatrix} c_2 & c_1 & c_2 \\ c_1 & c_0 & c_1 \\ c_2 & c_1 & c_2 \end{vmatrix} \quad (4)$$

The crosstalk correction matrix does reduce the crosstalk effect from its immediate neighbors, but the resulting backlight image is still inaccurate with a too-low contrast. Another problem is that it produces many out of range driving values that have to be truncated and can result in more errors.

Since the LCD output can not be more than 1, the LED driving value must be derived so that backlight is larger than target luminance, e.g., $$\text{led}(i,j):\{\text{led}(i,j)*\text{psf}(x,y) \geqq I(x,y)\} \quad (5)$$

In Equation 5, ":" is used to denote the constraint to achieve the desired LED values of the function in the curly bracket. Because of the limited contrast ratio (CR), due to leakage, LCD(x,y) can no longer reach 0. The solution is that when a target value is smaller than LCD leakage, the led value may be reduced to reproduce the dark luminance.

$$\text{led}(i,j):\{\text{led}(i,j) \otimes \text{psf}(x,y) < I(x,y) \cdot \text{CR}\} \quad (6)$$

In some embodiments, another goal may be a reduction in power consumption so that the total LED output is reduced or minimized.

$$led(i, j):\left\{\min \sum_{i,j} led(i, j)\right\} \quad (7)$$

Flickering may be due to the non-stationary response of the LED combined with the mismatch between the LCD and LED. The mismatch can be either spatial or temporal. Flickering can be reduced or minimized by reducing the total led output fluctuation between frames.

$$led(i, j):\left\{\min\left(\sum_{i,j} [led_t(i, j) - led_{t-1}(i - v_x t, j - v_t t)]\right)\right\} \quad (8)$$

where $v_x$ and $v_y$ are the motion speed in term of LED blocks. Combining Equations 5 and 8 yields Equation 9 below.

$$led(i, j):\left\{\begin{array}{l} led(i, j) * psf(x, y) \geq I(x, y) \\ led(i, j) * psf(x, y) < I(x, y) \cdot CR \\ \min \sum_{i,j} led(i, j) \\ \min\left(\sum_{i,j} [led_t(i, j) - led_{t-1}(i - v_x t, j - v_t t)]\right) \end{array}\right\} \quad (9)$$

In some embodiments, the algorithm to derive the backlight values that satisfy Eq. 8 comprises the following steps:

1. A single pass routine to derive the LED driving values with a constraint that led>0.
2. Post-processing: for those LED with driving value more than 1 (maximum), threshold to 1 and then using anisotropic error diffusion to distribute the error to its neighboring LEDs Finding an LED driving value from a target value is an ill-posed problem that requires an iterative algorithm, which is difficult to implement in hardware. The method, of some embodiments of the present invention, can be implemented as a single pass method. These embodiments may be described with reference to FIG. 5. In these embodiments, LED driving values are determined for a new frame 60. These values may be determined using 62 the difference between the target backlight (BL) and previous backlight ($BL_{i-1}$). This difference may be scaled by a scale factor that may, in some embodiments, range from 0.5 to 2 times the inverse of the sum of the PSF. Previous backlight values may be extracted from a buffer 64. The new driving value ($LED_i$) is the sum of the previous LED driving value ($Led_{i-1}$) and the scaled difference. The new backlight may be estimated 66 by the convolution of the new LED driving value and the PSF 68 of the LED.

In some embodiments, the derived LED value 67 from the single pass algorithm can be less than 0 and greater than 1. Since the LED can only be driven between 0 (minimum) and 1 (maximum), these values may be truncated to 0 or 1. Truncation to 0 still satisfies Eq. 4, but truncation to 1 does not. This truncation causes a shortfall in backlight illumination. In some embodiments, this shortfall may be compensated by increasing the driving value of neighboring LEDs. In some embodiments, this may be performed by error diffusion methods. An exemplary error diffusion method is illustrated in FIG. 6.

In some embodiments, a post processing algorithm may be used to diffuse this error as follows:

1. For these $led_{i,j}>1$
2. $tmpVal=led_{i,j}-1$;
3. set $led_{i,j}=1$;
4. Sort the 4 neighboring LEDs to ascending order
5. If (max−min<min(diffThd, tmpVal/2)

All the neighbor LEDs are increased by tmpVal/2 else

They are increased by errWeight*tmpVal*2.

where ErrWeight is the array for error diffusion coefficients based on the rank order. In an exemplary embodiment, errWeight=[0.75 0.5 0.5 0.25], where the largest coefficient is for the neighboring LED with the lowest driving value, and the smallest coefficient is for the neighboring LED with the highest driving value.

In some situations, the LED output may be non-linear with respect to the driving value, and, if the driving value is an integer, inverse gamma correction and quantization may be performed to determine the LED driving value. FIG. 7 illustrates an exemplary process of inverse gamma correction for LED values wherein normalized LED output values 70 are converted, via a tonescale curve 72, to driving values 74.

Figure 8:
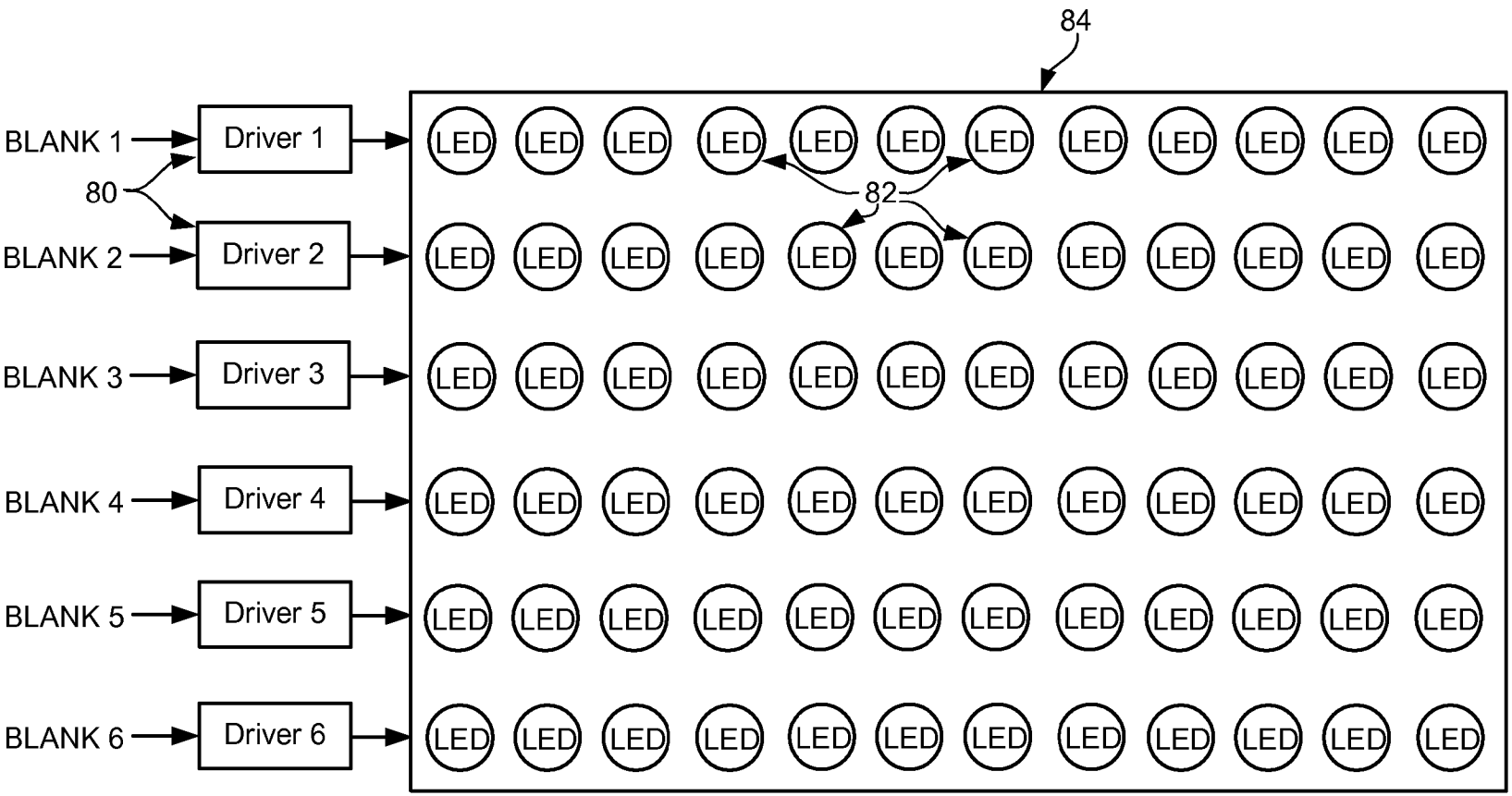
FIG. 8 is a diagram showing how a blank signal is fed to drivers in an LED array.

LED driving is commonly done with pulse width modulation (PWM), where the LED driving current is fixed and its duration or "on" time determines the light output. This pulse width driving at a 60 Hz frame rate can cause flickering. Therefore, two PWM pulses are typically used in prior art methods. This doubles the backlight refresh rate so that flickering is reduced or eliminated. However, the use of two PWM pulses may cause motion blur at higher duty-cycles or ghosting (double edges) at lower duty-cycles. To reduce both flickering and motion blur, motion adaptive LED driving may be used. FIG. 8 illustrates an arrangement for LED drivers 80 and LED backlight elements 82 in a display 84.

Figure 9:
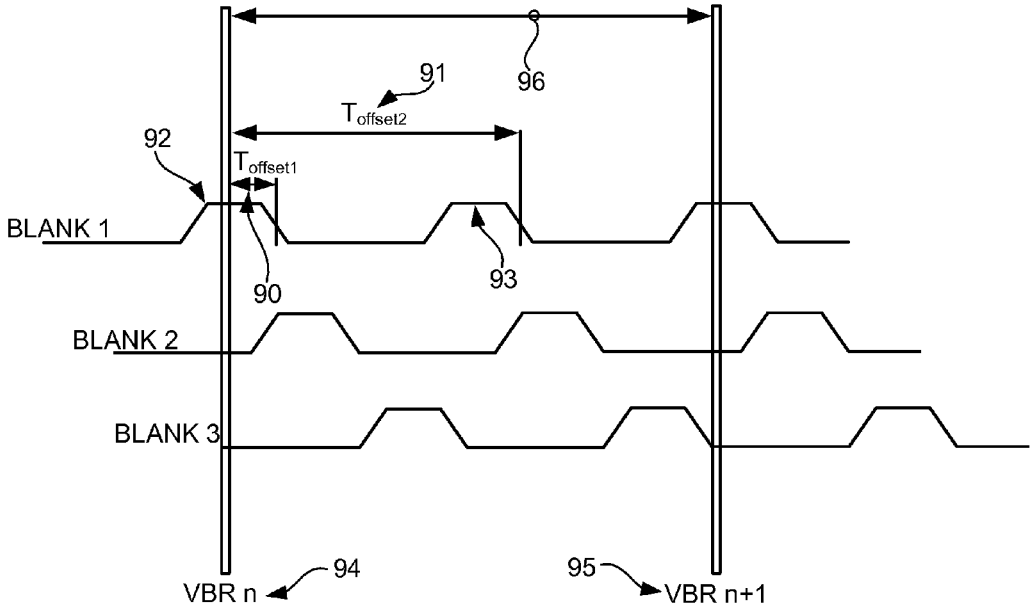
FIG. 9 is a diagram showing synchronized timing for backlight flashing.

To compensate for the time difference between LCD driving from top to bottom, a BLANK signal is used to synchronize PWM driving with the LCD driving. These embodiments may be further illustrated with reference to FIG. 9. In these embodiments, the BLANK signal shifts to the right according to the vertical position. There are two "on" pulses 92 and 93 in the BLANK signal to trigger the two PWM pulses. $VBR_n$ 94 and $VBR_{n+1}$ 95 are two vertical blanking retracing (VBR) signals, which define an LCD frame time 96. For each LCD frame, there are two LED PWM pulses 92 and 93. The time between the two PWM pulses ($T_{offset2}-T_{offset1}$) 91 is exactly half of the LCD frame time 96. $T_{offset1}$ 90 and $T_{offset2}$ 91 are adjusted based on the BLANK signal to synchronize with the LCD driving. For shorter duty cycles (i.e., duty cycle less than 100%). $T_{offset1}$ 90 and $T_{offset2}$ 91 should be shifted to the right so that PWM "on" occurs at the flat part of the LCD temporal response curve.

The use of two PWM pulses in one LCD enables motion adaptive backlight flashing. If there is no detected motion, the two PWM pulses may have the same width, but may be offset in time by half of an LCD frame time. If the LCD frame rate is 60 Hz, the perceived image is actually 120 Hz, thereby eliminating the perception of flickering. If motion is detected, PWM pulse 1 92 may be reduced or eliminated, while the width of PWM pulse 2 93 is increased to maintain the overall brightness. Elimination of PWM pulse 1 92 may significantly reduce the temporal aperture thereby reducing motion blur.

Figure 10:
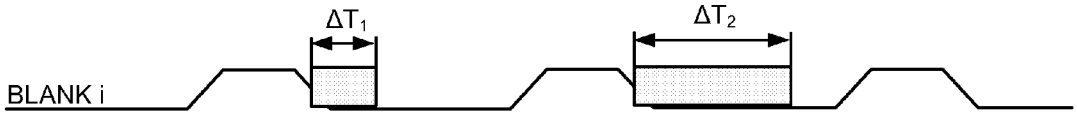
FIG. 10 is a diagram showing pulse width modulated pulses in LED driving.
Figure 11:
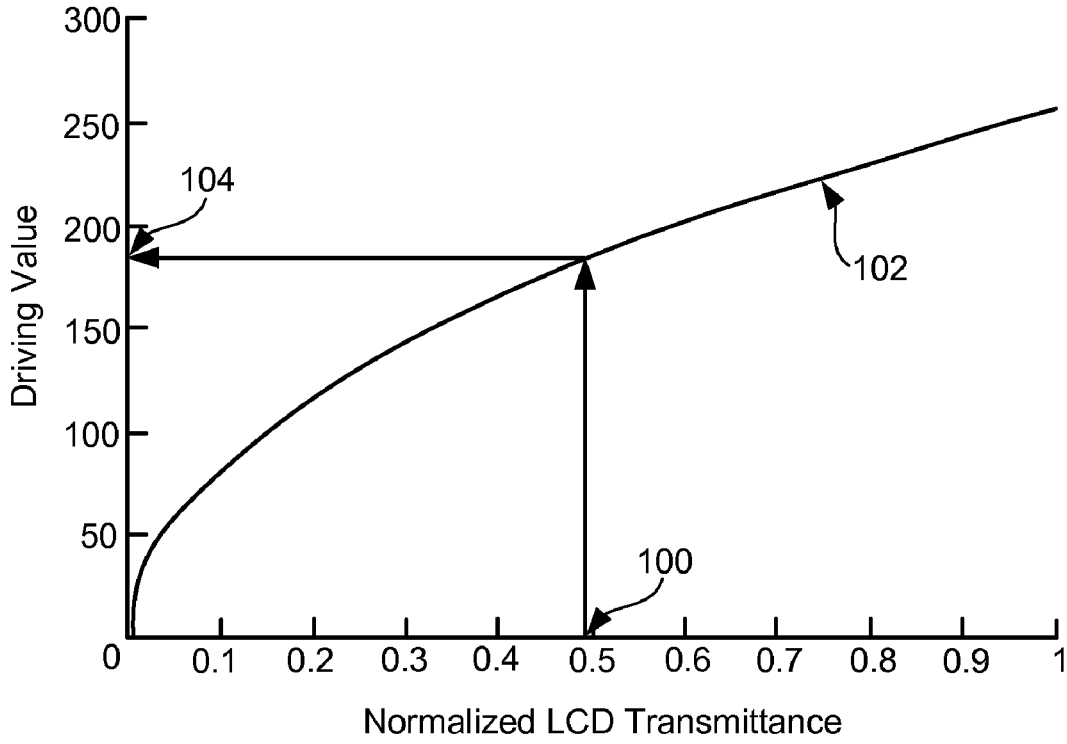
FIG. 11 is a graph showing an exemplary LCD inverse gamma correction.

FIG. 10 shows the PWM pulses in LED driving. Assume the LED intensity is I {0,1} and duty cycle is λ {0,100%}, the PWM "on" time in terms of fraction of LCD frame time is given by $$\Delta T(i,j) = \lambda I(i,j) \tag{10}$$

$$\Delta T_2(i,j) = \left(1 + \frac{mMap(i,j)}{4}\right)\frac{\Delta T(i,j)}{2}$$

$$\Delta T_1 = \Delta T - \Delta T_2$$

In some embodiments, the next step is to predict the backlight image from the LED. The LED image may be upsampled to the LCD resolution (m×n) and convolved with the PSF of the LED.

The LCD transmittance may be determined using Equation 10.

$$T_{LCD}(x,y)=\mathrm{img}(x,y)/\mathrm{bl}(x,y) \tag{10}$$

In some embodiments, inverse gamma correction may also be performed to correct the nonlinear response of the LCD. In these embodiments, a normalized LCD transmittance value 100 may be mapped with a tonescale curve 102 to an LCD driving value 104.

The terms and expressions which have been employed in the foregoing specification are used therein as terms of description and not of limitation, and there is no intention in the use of such terms and expressions of excluding equivalence of the features shown and described or portions thereof.

What is claimed is:

1. A method for generating a backlight image for a display backlight array, said method comprising:

a) receiving an input image comprising an array of pixel values representing an image at a first resolution;

b) subsampling said input image to create an intermediate resolution image, wherein said intermediate resolution image has a resolution that is lower than said first resolution and wherein said intermediate resolution image comprises sub-block values, each of which correspond to a different plurality of input image pixel values;

c) determining a current-frame sub-block characteristic for each of said pluralities of input image pixel values;

d) determining a previous-frame sub-block characteristic for pluralities of input image pixel values in a previous frame;

e) creating a motion map with motion elements for each backlight element, wherein the resolution of said backlight elements is less than said intermediate resolution and a plurality of said sub-blocks corresponds to one of said motion elements, said creating occurring by comparing said previous-frame sub-block characteristics to said current-frame sub-block characteristics, wherein one of said motion elements, indicates motion when one of said previous-frame sub-block characteristics, for a particular sub-block corresponding to said motion element, is substantially different than the current-frame sub-block characteristic corresponding to said particular sub-block;

f) creating a motion status map, wherein said motion status map comprises motion status elements corresponding to each of said motion elements, wherein the value of said motion status elements increases incrementally with each successive frame to a maximum motion status value when a corresponding motion status element of a previous frame indicates motion and the value of said motion status elements decreases incrementally with each successive frame to a minimum motion status value when a corresponding motion status element of a previous frame does not indicate motion;

g) calculating a local LED maximum value within a window containing a current LED driving value;

h) calculating, based on a corresponding one of said motion status elements, an updated LED driving value that is a weighted combination of said current LED driving value and said LED maximum value.

2. A method as described in claim 1 further comprising low-pass filtering said input image to create said intermediate-resolution image.

3. A method as described in claim 1 wherein said previous-frame sub-block characteristic and said current-frame sub-block characteristic are average pixel values for pixels corresponding to said sub-blocks.

4. A method as described in claim 1 wherein said maximum motion status value is 4.

5. A method as described in claim 1 wherein said minimum motion status value is 0.

6. A method as described in claim 1 wherein said creating a motion status map comprises assigning a value to a motion status element that is the minimum of 4 and one more than the motion status element of a corresponding motion status element in a previous frame when said motion status element corresponds to a motion element that indicates motion.

7. A method as described in claim 1 wherein said creating a motion status map comprises assigning a value to a motion status element that is the maximum of zero and one less than the value of a corresponding motion status element in a previous frame when said motion status element corresponds to a motion element that does not indicate motion.

8. A method as described in claim 1 wherein said updated LED driving value is calculated with the following equation:

$$LED_2(i, j) = \left(1 - \frac{mMap}{4}\right)LED_1(i, j) + \frac{mMap}{4}LED_{max}(i, j)$$

wherein LED2 is the updated LED driving value, mMap is the motion status element value corresponding to the updated LED driving value, LED1 is a current LED driving value based on input image content and LEDmax is the local LED maximum value.

9. A method as described in claim 1 wherein said LED maximum value window is a square window centered on said current LED driving value.

10. A method as described in claim 1 wherein said LED maximum value window is a one-dimensional window aligned with a motion vector corresponding to said current LED driving value.

11. A method for generating a backlight image for a display backlight array, said method comprising:

a) receiving an input image comprising an array of pixel values representing an image at a first resolution;

b) low-pass filtering said input image to create a low-pass filtered (LPF) image;

c) subsampling said LPF image to create an LED resolution image, wherein said LED resolution image has a resolution that is lower than said first resolution and wherein said LED resolution image comprises backlight elements, each of which correspond to a different plurality of input image pixel values;

d) creating a motion map with motion elements for each backlight element, wherein the resolution of said backlight elements is the same as said LED resolution, and wherein said motion elements indicate motion based on a comparison of current frame characteristics and previous frame characteristics;

e) creating a motion status map, wherein said motion status map comprises motion status elements corresponding to each of said motion elements, wherein the value of said motion status elements increases incrementally with each successive frame to a maximum motion status value when a corresponding motion status element of a previous frame indicates motion and the value of said motion status elements decreases incrementally with each successive frame to a minimum motion status value when a corresponding motion status element of a previous frame does not indicate motion;

f) calculating a local LED maximum value within a window containing a current LED driving value;

g) calculating, based on a corresponding one of said motion status elements, an updated LED driving value that is a weighted combination of said current LED driving value and said LED maximum value.

12. A method as described in claim 11 wherein said maximum motion status value is 4.

13. A method as described in claim 11 wherein said minimum motion status value is 0.

14. A method as described in claim 11 wherein said creating a motion status map comprises assigning a value to a motion status element that is the minimum of 4 and one more than the motion status element of a corresponding motion status element in a previous frame when said motion status element corresponds to a motion element that indicates motion.

15. A method as described in claim 11 wherein said creating a motion status map comprises assigning a value to a motion status element that is the maximum of zero and one less than the value of a corresponding motion status element in a previous frame when said motion status element corresponds to a motion element that does not indicate motion.

16. A method as described in claim 11 wherein said updated LED driving value is calculated with the following equation:

$$LED_2(i, j) = \left(1 - \frac{mMap}{4}\right)LED_1(i, j) + \frac{mMap}{4}LED_{max}(i, j)$$

wherein LED2 is the updated LED driving value, mMap is the motion status element value corresponding to the updated LED driving value, LED1 is a current LED driving value based on input image content and LEDmax is the local LED maximum value.

17. A method as described in claim 11 wherein said LED maximum value window is a square window centered on said current LED driving value.

18. A method as described in claim 11 wherein said LED maximum value window is a one-dimensional window aligned with a motion vector corresponding to said current LED driving value.

19. A method for selective isotropic and anisotropic error diffusion of out-of-range display backlight values, said method comprising:

a) determining an out-of-range error in a backlight value for a backlight element;

b) resetting said backlight value to an in-range value;

c) sorting the backlight values of neighboring backlight elements in ascending order;

d) increasing the values of said neighboring backlight elements proportionally when the minimum of a difference threshold and one half said error is greater than the difference between the maximum and the minimum of said neighboring backlight element values; and e) increasing said neighboring backlight element values in said ascending order by multiplying each of said element values by coefficients of decreasing value such that the lowest of said element values is multiplied by the largest coefficient and the highest of said element values is multiplied by the smallest coefficient.

20. A method for generating a backlight image for a display backlight array, said method comprising:

receiving an input image comprising an array of pixel values representing an image at a first resolution;

subsampling said input image to create an intermediate resolution image, wherein said intermediate resolution image has a resolution that is lower than said first resolution and wherein said intermediate resolution image comprises sub-block values, each of which correspond to a different plurality of input image pixel values;

determining a current-frame sub-block characteristic for each of said pluralities of input image pixel values;

determining a previous-frame sub-block characteristic for pluralities of input image pixel values in a previous frame;

creating a motion map with motion elements for each backlight element, wherein the resolution of said backlight elements is less than said intermediate resolution and a plurality of said sub-blocks corresponds to one of said motion elements, said creating occurring by comparing said previous-frame sub-block characteristics to said current-frame sub-block characteristics, wherein one of said motion elements, indicates motion when one of said previous-frame sub-block characteristics, for a particular sub-block corresponding to said motion element, is substantially different than the current-frame sub-block characteristic corresponding to said particular sub-block;

creating a motion status map, wherein said motion status map comprises motion status elements corresponding to each of said motion elements, wherein the value of said motion status elements increases incrementally with each successive frame to a maximum motion status value when a corresponding motion status element of a previous frame indicates motion and the value of said motion status elements decreases incrementally with each successive frame to a minimum motion status value when a corresponding motion status element of a previous frame does not indicate motion;

calculating a local LED maximum value within a window containing a current LED driving value;

calculating an updated LED driving value wherein said updated LED driving value is calculated with the following equation:

$$LED_2(i, j) = \left(1 - \frac{mMap}{4}\right)LED_1(i, j) + \frac{mMap}{4}LED_{max}(i, j)$$

wherein $LED_2$ is the updated LED driving value, mMap is the motion status element value corresponding to the updated LED driving value, $LED_1$ is a current LED driving value based on input image content, $LED_{max}$ is the local LED maximum value and i and j are backlight array coordinates.

21. A method for generating a backlight image for a display backlight array, said method comprising:

receiving an input image comprising an array of pixel values representing an image at a first resolution;

low-pass filtering said input image to create a low-pass filtered (LPF) image;

subsampling said LPF image to create an LED resolution image, wherein said LED resolution image has a resolution that is lower than said first resolution and wherein said LED resolution image comprises backlight elements, each of which correspond to a different plurality of input image pixel values;

creating a motion map with motion elements for each backlight element, wherein the resolution of said backlight elements is the same as said LED resolution, and wherein said motion elements indicate motion based on a comparison of current frame characteristics and previous frame characteristics;

creating a motion status map, wherein said motion status map comprises motion status elements corresponding to each of said motion elements, wherein the value of said motion status elements increases incrementally with each successive frame to a maximum motion status value when a corresponding motion status element of a previous frame indicates motion and the value of said motion status elements decreases incrementally with each successive frame to a minimum motion status value when a corresponding motion status element of a previous frame does not indicate motion;

calculating a local LED maximum value within a window containing a current LED driving value;

calculating an updated LED driving value, wherein said updated LED driving value is calculated with the following equation:

$$LED_2(i, j) = \left(1 - \frac{mMap}{4}\right)LED_1(i, j) + \frac{mMap}{4}LED_{max}(i, j)$$

wherein $LED_2$ is the updated LED driving value, mMap is the motion status element value corresponding to the updated LED driving value, $LED_1$ is a current LED driving value based on input image content, $LED_{max}$ is the local LED maximum value and i and j are backlight array coordinates.

* * * * *